US008727516B2

(12) United States Patent
Harvey et al.

(10) Patent No.: US 8,727,516 B2
(45) Date of Patent: May 20, 2014

(54) FLUID CARTRIDGE

(75) Inventors: David C. Harvey, Portland, OR (US); David Olsen, Corvallis, OR (US); Ralph L. Stathem, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/880,332

(22) PCT Filed: Jul. 22, 2011

(86) PCT No.: PCT/US2011/044943

§ 371 (c)(1), (2), (4) Date: Apr. 18, 2013

(87) PCT Pub. No.: WO2012/054112

PCT Pub. Date: Apr. 26, 2012

(65) Prior Publication Data

US 2013/0208061 A1 Aug. 15, 2013

(51) Int. Cl.
*B41J 2/175* (2006.01)
*B41J 2/14* (2006.01)

(52) U.S. Cl.
USPC ..... 347/86; 347/49

(58) Field of Classification Search
USPC ..... 347/49, 85, 86, 87
See application file for complete search history.

(56) References Cited

U.S. PATENT DOCUMENTS

| | | | | |
|---|---|---|---|---|
| 5,734,401 | A * | 3/1998 | Clark et al. | 347/86 |
| 5,835,817 | A | 11/1998 | Bullock et al. | |
| 5,949,459 | A * | 9/1999 | Gasvoda et al. | 347/86 |
| 6,130,695 | A * | 10/2000 | Childers et al. | 347/85 |
| 6,170,937 | B1 | 1/2001 | Childers et al. | |
| 6,302,535 | B1 * | 10/2001 | Sturgeon et al. | 347/86 |
| 6,471,333 | B1 * | 10/2002 | Powell et al. | 347/49 |
| 6,722,762 | B2 * | 4/2004 | Miyazawa et al. | 347/86 |
| 6,959,985 | B2 * | 11/2005 | Steinmetz et al. | 347/86 |
| 7,226,154 | B2 | 6/2007 | Seino et al. | |
| 7,252,375 | B2 | 8/2007 | Shinada et al. | |
| 7,506,973 | B2 | 3/2009 | Steinmetz et al. | |
| 7,703,902 | B2 | 4/2010 | Nozawa et al. | |
| 7,934,794 | B2 | 5/2011 | Miyazawa et al. | |
| 2004/0027432 | A1 | 2/2004 | Childers et al. | |
| 2007/0013753 | A1 | 1/2007 | Steinmetz et al. | |
| 2008/0168481 | A1 | 7/2008 | Lan et al. | |

FOREIGN PATENT DOCUMENTS

| | | | |
|---|---|---|---|
| EP | 1348562 | A2 | 10/2003 |
| EP | 1122078 | A2 | 8/2011 |
| GB | 2316657 | A | 3/1998 |
| WO | WO-2010134907 | A1 | 11/2010 |

* cited by examiner

*Primary Examiner* — Anh T. N. Vo

(57) ABSTRACT

In one example, a fluid cartridge includes a reservoir for holding a fluid, an electrical interface, an alignment feature, and a keying feature. The alignment feature is configured to, as the cartridge is inserted into a receiver, bias the electrical interface against a corresponding electrical interface on the receiver. The keying feature discriminates the cartridge from other fluid cartridges to prevent the cartridge from being inserted incorrectly into the receiver.

20 Claims, 10 Drawing Sheets

FLUID CARTRIDGE

BACKGROUND

Replaceable ink cartridges for inkjet printers must be accurately aligned as the cartridges are inserted into the carriage or other receiver so that the electrical and fluid interfaces on each cartridge properly engage the corresponding interfaces on the receiver.

DRAWINGS

The same part numbers designate the same or similar parts throughout the figures.

DESCRIPTION

A new fluid cartridge and receiver assembly has been developed with alignment features that help accurately align the cartridge as it is inserted into the receiver so that an electrical interface on the cartridge properly engages the corresponding electrical interface on the receiver. Examples of a new fluid cartridge and a new receiver are described below with reference to an ink cartridge assembly for an inkjet printer. However, examples of the new cartridge and the new receiver are not limited to ink cartridges, inkjet printers or inkjet printing. The new fluid cartridge and receiver might also be implemented, for example, in other types of fluid dispensers. The examples shown in the figures and described below, therefore, illustrate but do not limit the invention, which is defined in the Claims following this Description.

Figure 1:
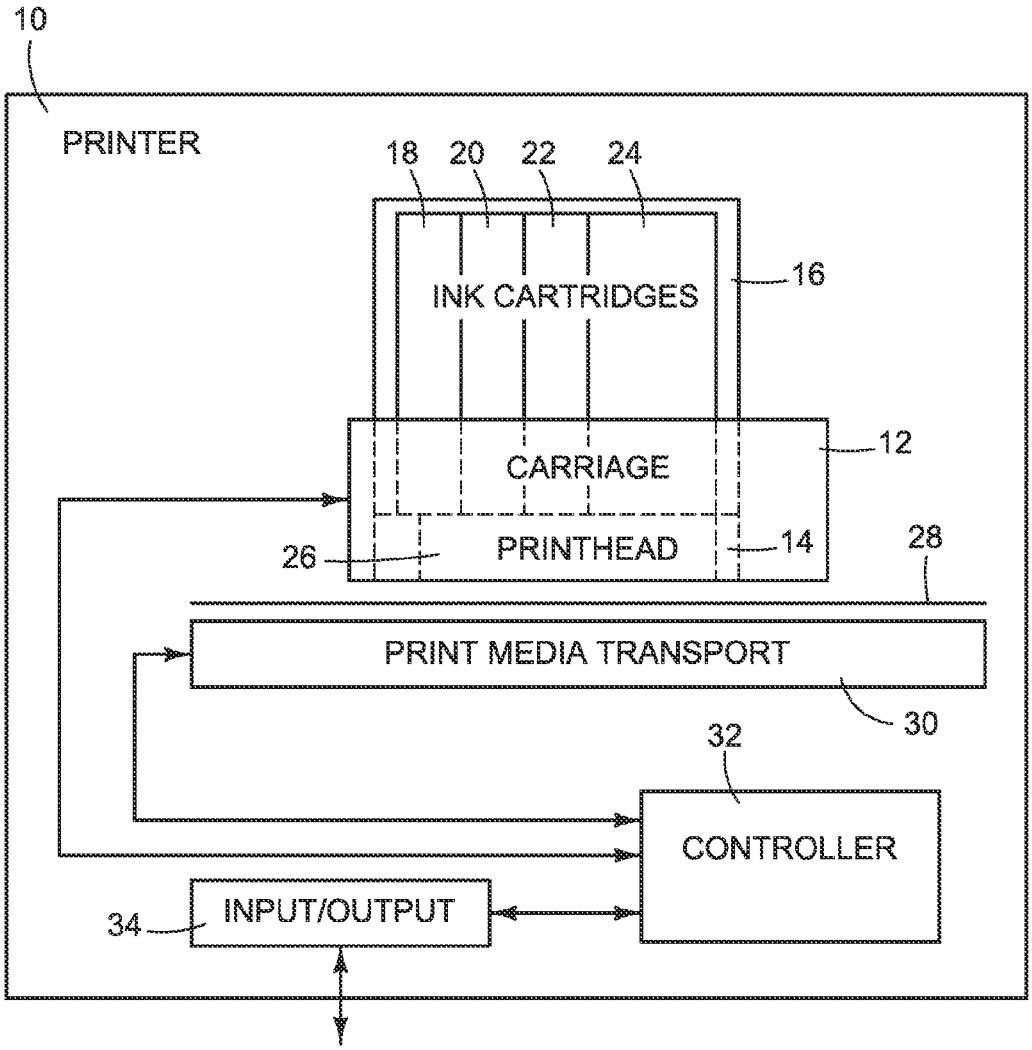
FIG. 1 is a block diagram illustrating one embodiment of an inkjet printer in which examples of a new fluid cartridge and receiver assembly may be implemented.

FIG. 1 is a block diagram illustrating one embodiment of an inkjet printer 10 in which examples of a new fluid cartridge and receiver assembly may be implemented. Referring to FIG. 1, printer 10 includes a carriage 12 carrying a printhead module 14. Printhead module 14 includes a cartridge assembly 16 holding a series of replaceable ink cartridges 18, 20, 22, and 24 connected to a printhead 26. For example, each ink cartridge may hold a different color ink, such as black (K), yellow (Y), cyan (C), and magenta (M). Although ink cartridges 18-24 in assembly 16 are shown in FIG. 1 as part of a printhead module 14 mounted in carriage 12, other configurations are possible. For example, ink cartridges 18-24 may be located remote from printhead 26 and carriage 12 in a so-called "off axis" ink supply configuration.

Printhead 26 represents generally the operative components needed to expel ink from module 14 on to a print medium 28. For example, an inkjet printhead 26 is typically a small electromechanical assembly that contains an array of miniature thermal, piezoelectric or other devices that are energized or activated to eject tiny droplets of ink out of an associated array of nozzles. Printhead 26 may be formed, for example, as a series of discrete printheads each integrated into or otherwise serving one or more ink cartridges 18-24, or as a single printhead serving all of cartridges 18-24 through multiple nozzle arrays and corresponding fluid delivery channels.

A print media transport mechanism 30 advances print medium 28 past carriage 12 and printhead 26. For a movable, scanning carriage 12, media transport 30 typically will advance medium 28 incrementally past carriage 12, stopping as each swath is printed and then advancing medium 28 for printing the next swath. For a stationary carriage 12, media transport 30 may advance print medium 28 continuously past carriage 12 and printhead 26. A printer controller 32 is operatively connected to carriage 12, ink cartridges 18-24, printhead 26, and media transport 30. Controller 32 in FIG. 1 represents generally the programming, processor and associated memory, and the electronic circuitry and components needed to control the operative elements of a printer 10. Controller 32 may communicate with external devices through an input/output device 34, including receiving print data for inkjet imaging. By coordinating the relative position of carriage 12 with medium 28 and the ejection of ink drops, controller 32 produces the desired image on medium 28.

Figure 2:
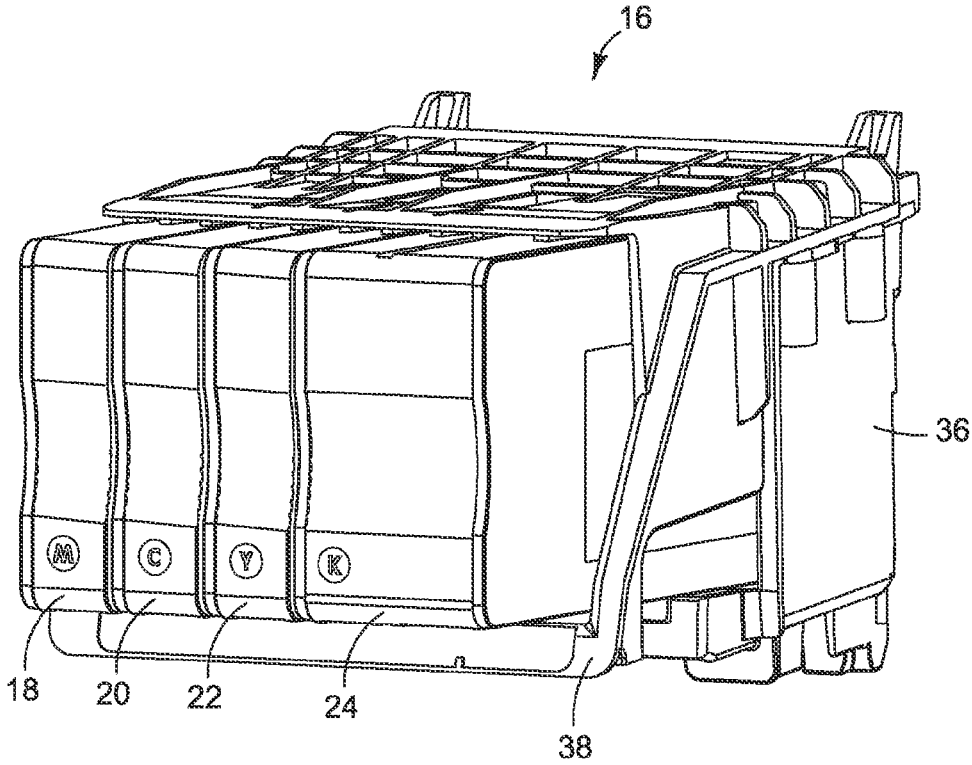
FIG. 2 illustrates one example of a new ink cartridge and receiver assembly, such as might be used in the printer of FIG. 1.
Figure 3:
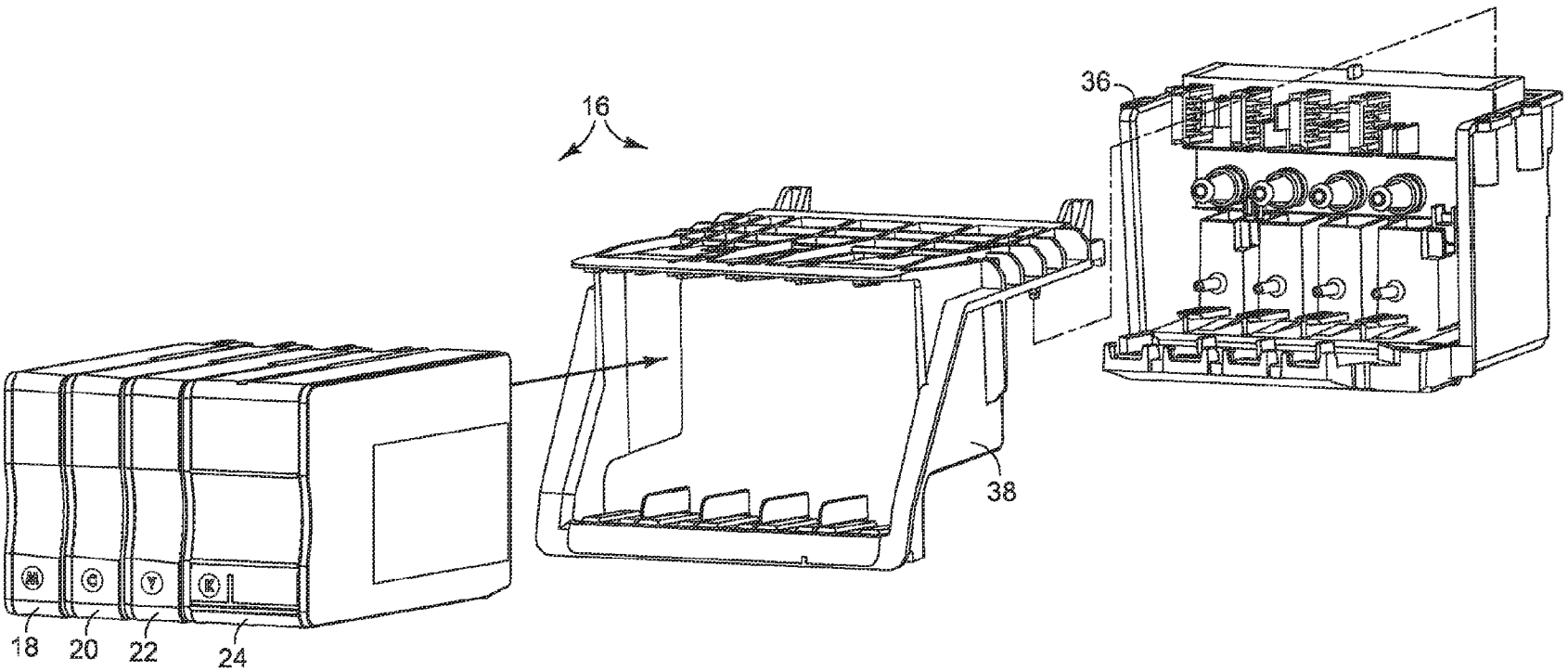
FIG. 3 is an exploded view of the ink cartridge and receiver assembly shown in FIG. 2.

FIGS. 2 and 3 illustrate one example of a new ink cartridge and receiver assembly 16, such as might be used in printer 10 shown in FIG. 1. Referring to FIGS. 2 and 3, assembly 16 includes ink cartridges 18-24 installed in a receiver 36. In the example shown, cartridge assembly 16 also includes a discrete guide unit 38 that helps properly position and support each cartridge 18-24 in receiver 36.

Figure 4:
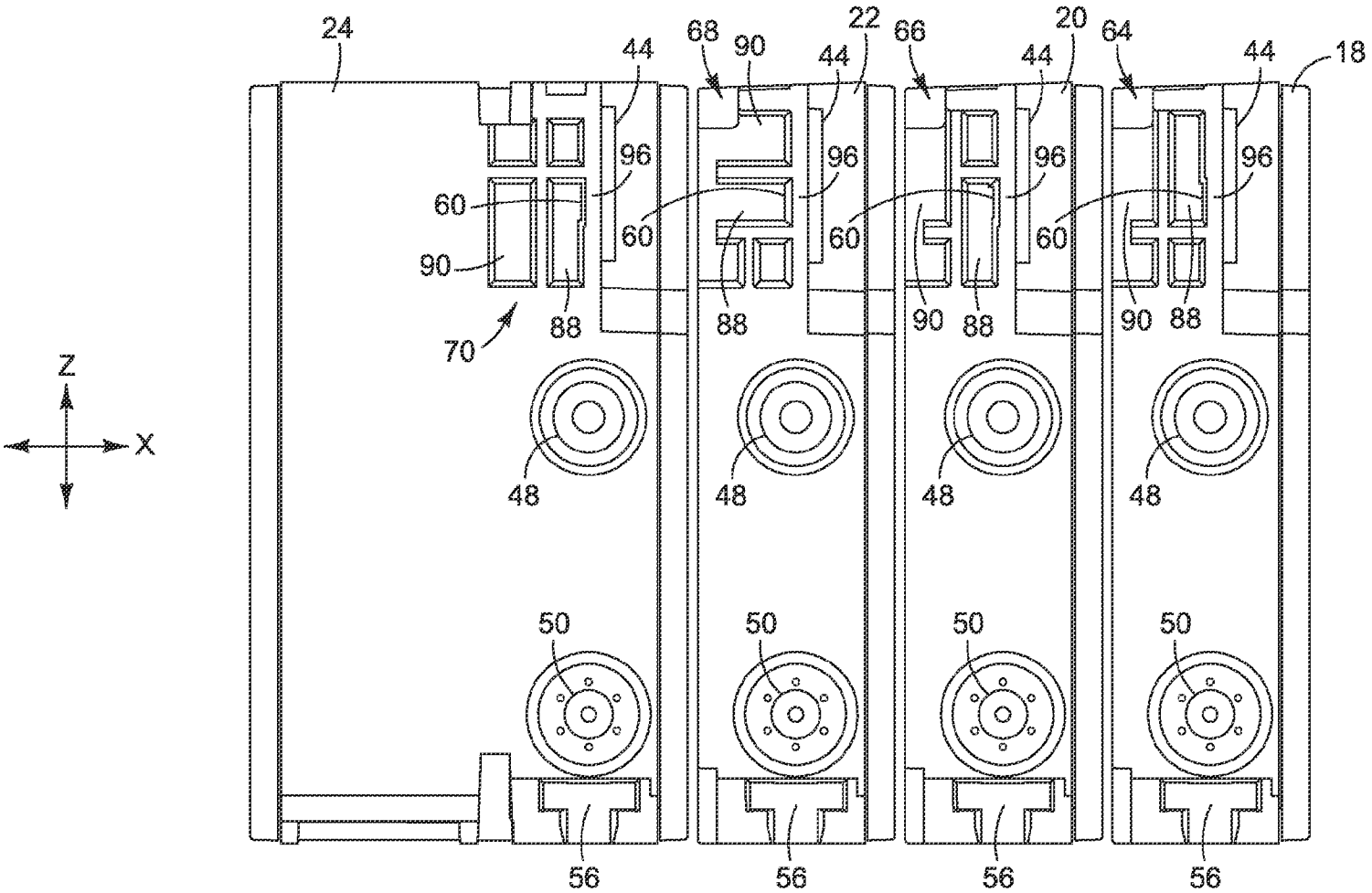
FIG. 4 is a front end view of one example of a set of ink cartridges that may be used in the assembly shown in FIGS. 1 and 2.
Figure 5:
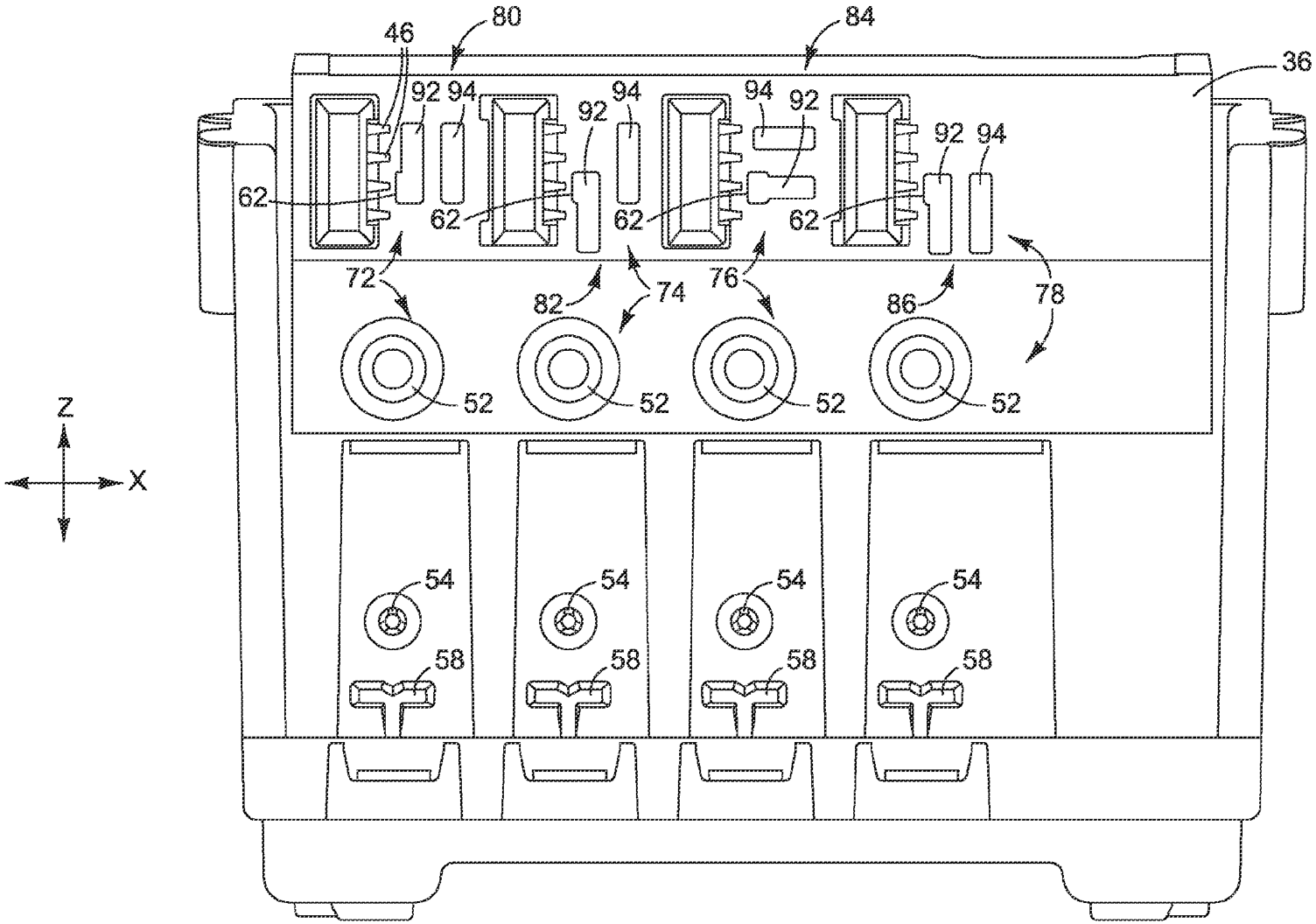
FIG. 5 is a front view of one example of a cartridge receiver that may be used in the assembly shown in FIGS. 1 and 2 with the cartridge set of FIG. 4.
Figure 7:
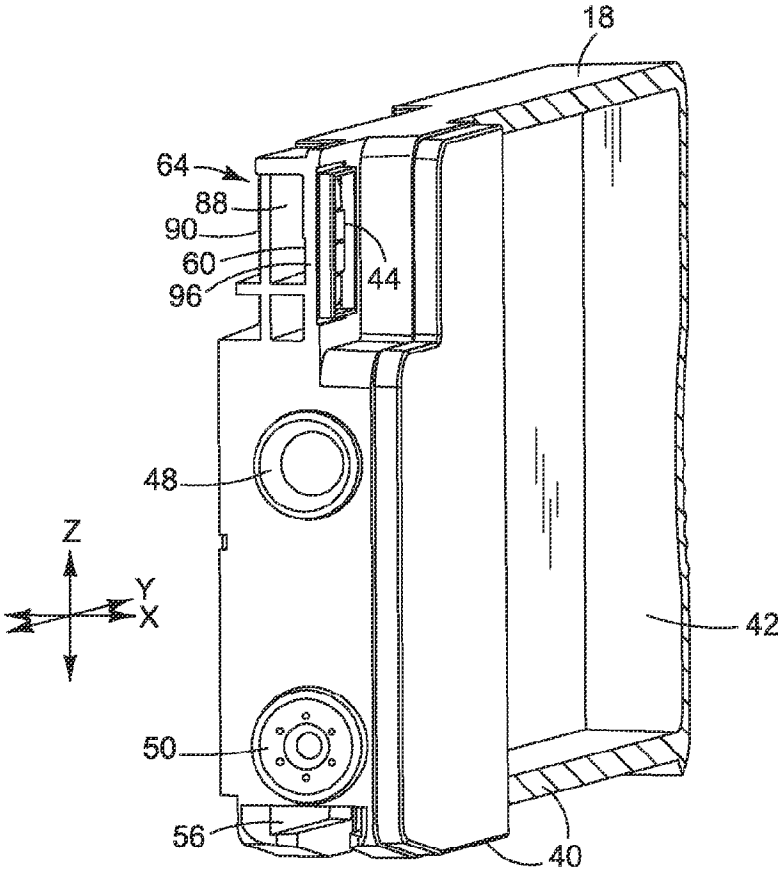
FIGS. 6 and 7 are detail views of one of the ink cartridges in the set shown in FIG. 4.
Figure 6:
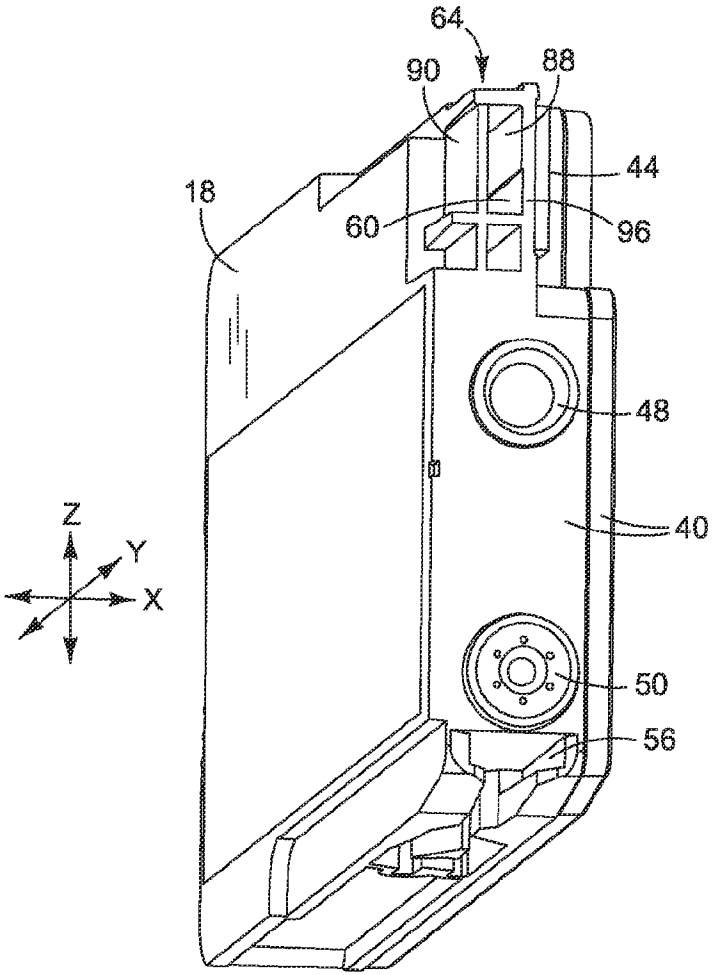

FIG. 4 is a front end view of one example set of ink cartridges 18-24. FIG. 5 is a front view of one example of a cartridge receiver 36. FIGS. 6 and 7 are detail views of ink cartridge 18 and FIGS. 8-12 are detail views showing the insertion of ink cartridge 18 into receiver 36. Referring first to FIGS. 4-7, the housing 40 of each ink cartridge 18-24 forms an interior reservoir 42 (FIG. 7) for holding ink. Each ink cartridge 18-24 includes an electrical interface 44 that contacts a corresponding electrical interface 46 on receiver 36. For example, each ink cartridge 18-24 may include a small electronic data storage chip and/or processing device that communicates with controller 32 (FIG. 1) through electrical interfaces 44 and 46. Each ink cartridge 18-24 also includes an ink port 48 and an air port 50 that connect to corresponding ink and air ports 52 and 54 on receiver 36 for exchanging ink and air, respectively, with a printhead 26 (FIG. 1) operatively coupled to receiver 36. Thus, ports 48, 50 on cartridges 18-24 and ports 52, 54 on receiver 36 form fluid interfaces between cartridges 18-24 and receiver 36.

Cartridge assembly 16 (FIGS. 2 and 3) utilizes two alignment features to accurately align cartridges 18-24 as they are inserted into receiver 36 so that the electrical and fluid interfaces 44, 48, 50 on each cartridge 18-24 properly engage the corresponding interfaces 46, 52, 54 on receiver 36. As described in more detail below with reference to FIGS. 8-12, alignment is made with a T shaped slot 56 along the bottom of each cartridge 18-24 sliding into and along corresponding T shaped rails 58 in receiver 36. Alignment for fluid interfaces 48, 52 and 50, 54 is also made with tapered female ports 48, 50 on each ink cartridge 18-24 sliding over corresponding tapered male ports 52, 54 on receiver 36. Alignment for electrical interfaces 44, 46 is also made with a datum surface 60 for engaging a corresponding surface 62 on receiver 36 to bias each cartridge electrical interface 44 against the corresponding receiver electrical interface 46 in a direction perpendicular to the plane of datum surface 60.

Referring now specifically to FIGS. 4 and 6, each cartridge 18-24 includes a keying feature 64, 66, 68, and 70, respectively, discriminating each cartridge from the other cartridges in assembly 16 (FIG. 2). Referring now specifically to FIGS. 3 and 5, each cartridge receiving bay 72, 74, 76, and 78 in receiver 36 includes a keying feature 80, 82, 84, and 86, respectively, corresponding to cartridge keying features 64-70 to prevent a cartridge from being inserted into the incorrect bay. In the example shown in the figures, each cartridge keying feature 64-70 is formed by a unique (among the four cartridges) configuration of keyways 88, 90 and each receiver keying feature 80-86 is formed by a corresponding pair of keys 92, 94. In addition, as described in more detail below with reference to FIGS. 8-12, electrical interface datum surfaces 60 are formed in cartridge keyways 88 and the corresponding receiver surfaces 62 are formed on receiver keys 92. Thus, in the example shown, the keying and electrical interface alignment features share a common part both on cartridges 18-24 and on receiver 36.

Figure 8:
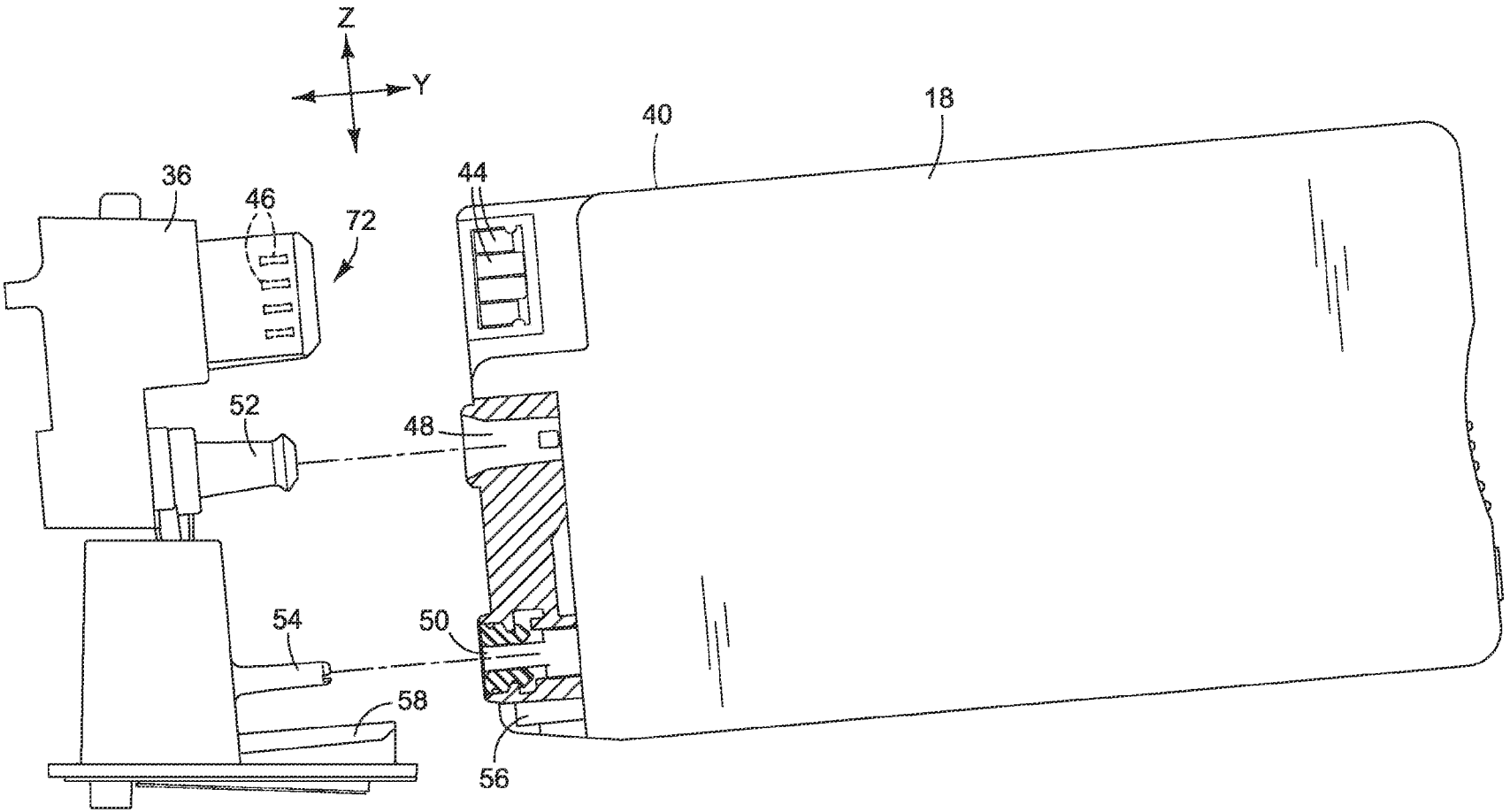
FIGS. 8 and 9 are side views showing the insertion of the ink cartridge of FIGS. 6 and 7 into the receiver of FIG. 5.
Figure 9:
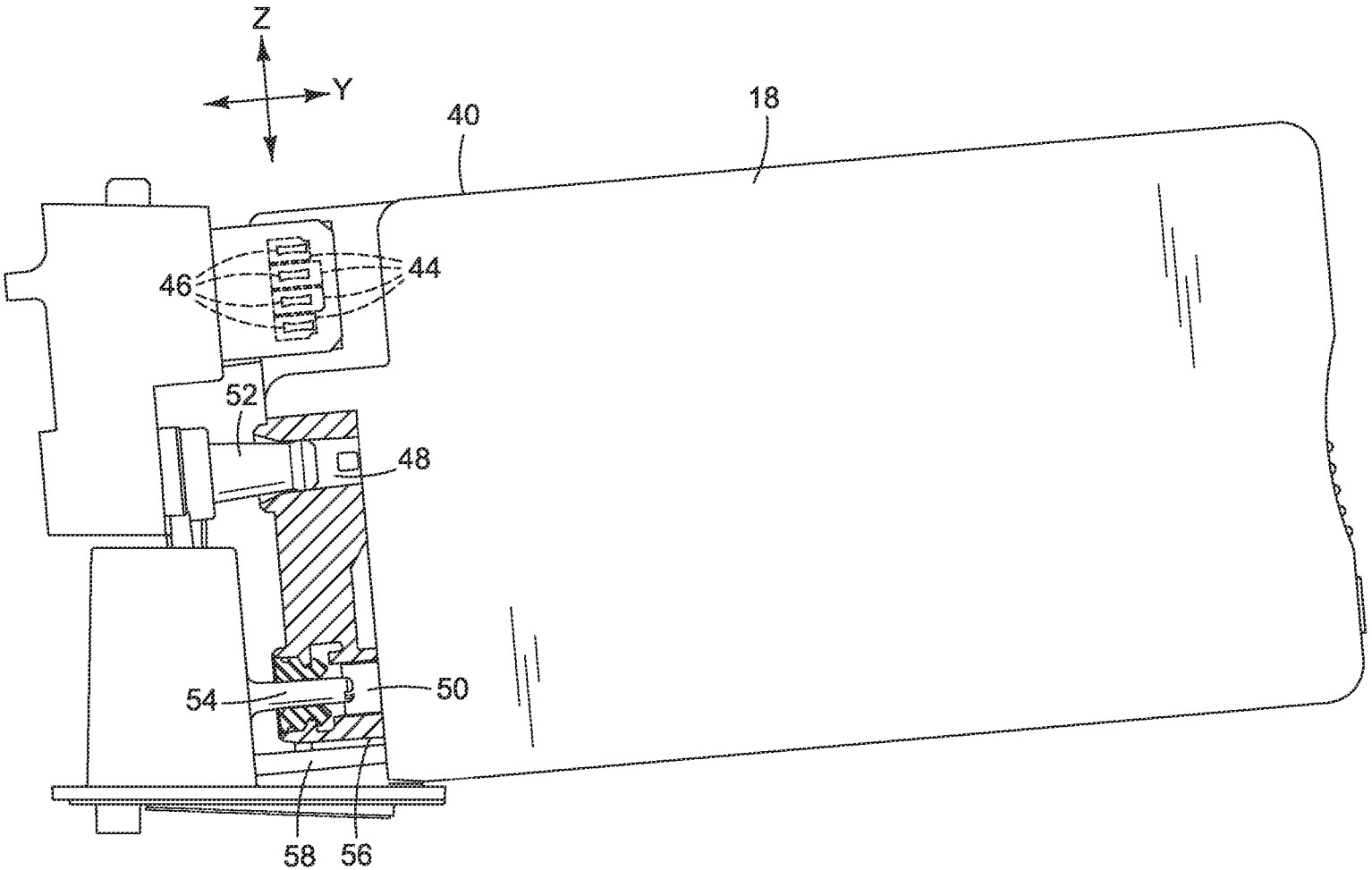
Figure 10:
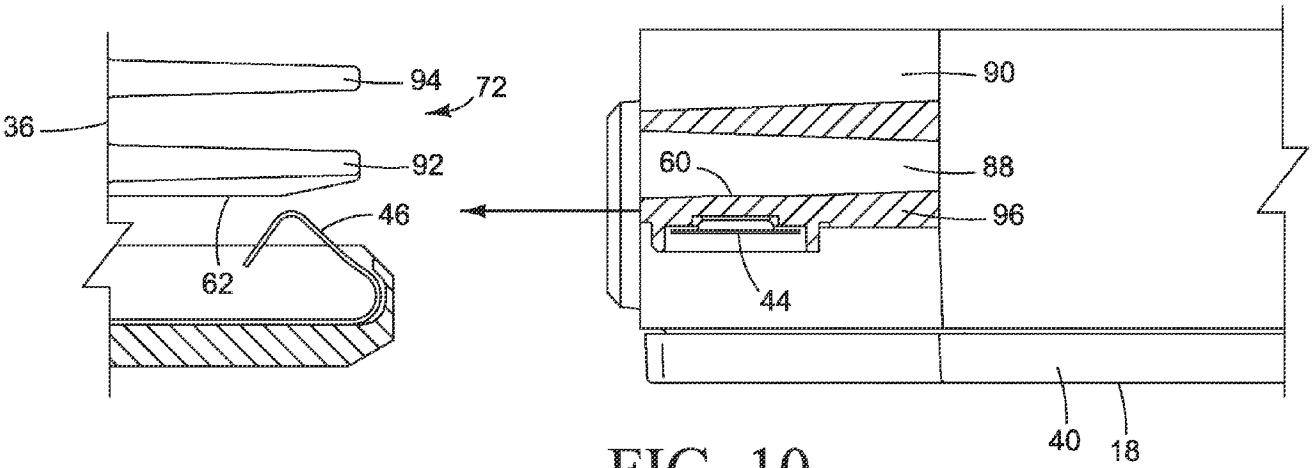
FIGS. 10 and 11 are detail plan views corresponding to the side views of FIGS. 8 and 9.
Figure 11:
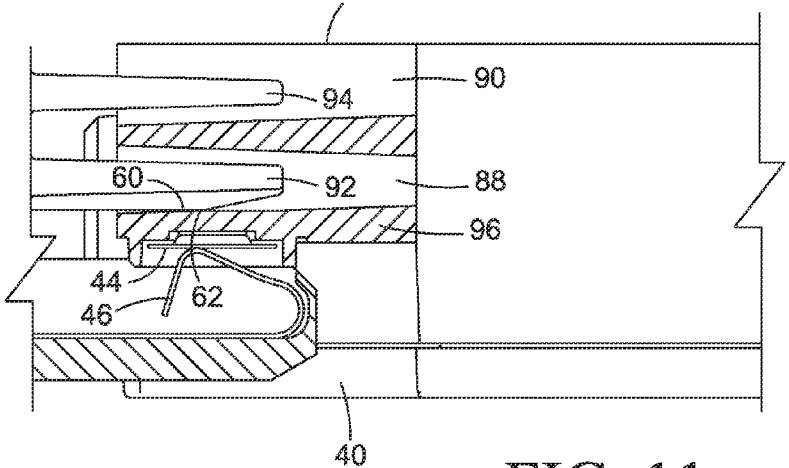
Figure 12:
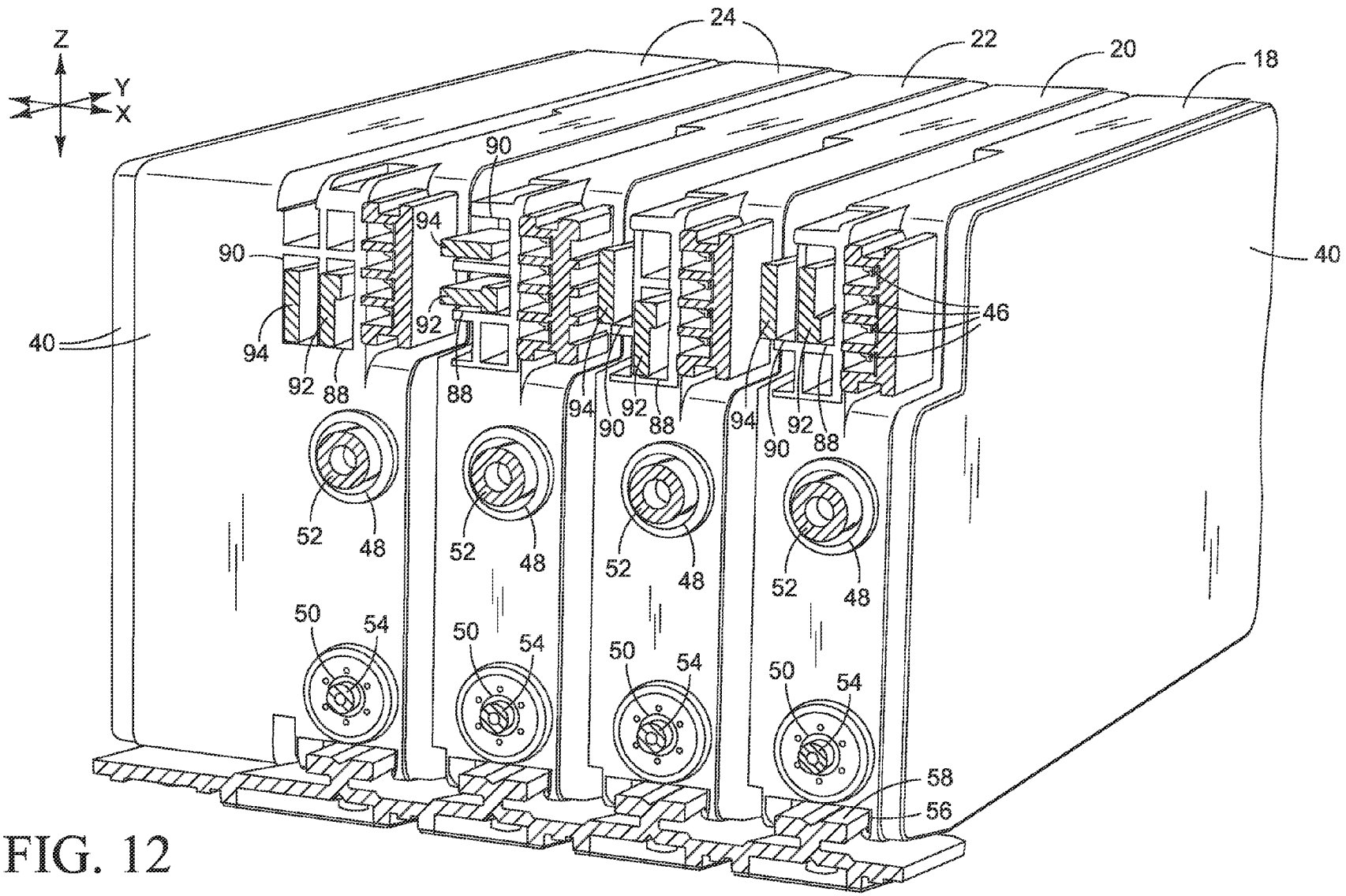
FIG. 12 is a detail perspective and partial section view showing the ink cartridge set of FIG. 4 installed in the receiver of FIG. 5.

FIGS. 8 and 9 are side views showing the insertion of ink cartridge 18 into receiver bay 72. FIGS. 10 and 11 are detail plan views corresponding to the side views of FIGS. 8 and 9. In FIGS. 8 and 10, cartridge 18 is not yet in contact with receiver 36. In FIGS. 9 and 11, cartridge 18 is fully inserted into receiver 36. Guide unit 38 (FIG. 3) is omitted from FIGS. 8-11 to more clearly illustrate the interface, alignment, and keying features on cartridge 18 and receiver 36. FIG. 12 is a perspective view and partial section detail view showing all four ink cartridges 18-24 in receiver 36 with the receiver parts shown in section.

Referring to FIGS. 8-12, cartridge 18 first engages receiver 36 as cartridge T slot 56 slides over and along receiver T rail 58 to bring the cartridge electrical and fluidic interfaces 44, 48, 50 into alignment in the X and Z directions with the corresponding receiver interfaces 46, 52, 54. If cartridge 24 is inserted into the wrong receiver bay, one or both receiver keys 92, 94 will not align with cartridge keyways 88, 90, to block continued insertion before contact is made at interfaces 44/46, 48/52 and 50/54. As cartridge 18 is pushed further into receiver bay 72, cartridge ink and air ports 48 and 50 slide onto receiver ink and air ports 52 and 54 and cartridge datum surface 60 bears against the stationary surface 62 on receiver 36 to push cartridge electrical interface 44 against receiver electrical interface 46 and to prevent cartridge 24 from rotating (about the Y axis) out of alignment in the XY plane. In the example shown, receiver electrical interfaces 46 are constructed as conductive spring tabs that are compressed slightly under the biasing pressure generated by the engagement of surfaces 60 and 62 to maintain good electrical contact between the cartridge and the receiver. Also, each pair of cartridge datum surfaces 60 and electrical interfaces 44 are formed on opposites sides of the same partition wall 96, which also forms part of each keyway 88. This configuration for datum surfaces 60, electrical interfaces 44 and keyways 88 reduces the tolerance stack across the top of each cartridge 18-24 to help maintain a consistent wall thickness and, according, to improve the alignment of the electrical interfaces, and shrinks the size requirement in the arrangement of these features.

As noted at the beginning of this Description, the examples shown in the figures and described above illustrate but do not limit the invention. Other forms, details, and examples may be made and implemented. Therefore, the foregoing description should not be construed to limit the scope of the invention, which is defined in the following claims.

What is claimed is:

1. A fluid cartridge insertable into and removable from a receiver, the cartridge comprising:
   a reservoir for holding a fluid;
   an electrical interface;
   an alignment feature configured to, as the cartridge is inserted into a receiver, bias the electrical interface against a corresponding electrical interface on the receiver; and
   a keying feature discriminating the cartridge from other fluid cartridges to prevent the cartridge from being inserted incorrectly into the receiver, wherein the keying feature and the alignment feature include a datum surface for engaging a corresponding surface on the receiver to bias the electrical interface against a corresponding electrical interface on the receiver,
   wherein the datum surface is positioned on a first side of a partition and the electrical interface is positioned on a second side of the partition opposite the first side.

2. The cartridge of claim 1, wherein the keying feature comprises a keyway formed in part by the first side of the partition for receiving a corresponding key on the receiver.

3. The cartridge of claim 2, wherein the keyway comprises:
   a first keyway formed in part by the first side of the partition for receiving a corresponding first key on the receiver; and
   a second keyway for receiving a corresponding second key on the receiver.

4. The cartridge of claim 1, wherein the alignment feature is configured to, when the cartridge is inserted into the receiver, simultaneously bias the electrical interface against a corresponding electrical interface on the receiver and prevent rotation of the cartridge in the receiver in at least one plane.

5. A replaceable ink cartridge for an inkjet printer, comprising a fluid cartridge of claim 1 and further comprising:
   a housing having the reservoir therein for holding ink;
   the electrical interface affixed to the housing;
   an ink interface on the housing operatively connected to the reservoir;
   a further alignment feature on the housing configured to, as the cartridge is inserted into a receiver, bring the electrical and ink interfaces into coarse alignment with corresponding interfaces on the receiver.

6. The ink cartridge of claim 5, wherein:
   the keying feature comprises an elongated keyway for receiving a corresponding key on the receiver; and
   the alignment feature comprises a planar surface interior to the keyway for engaging a corresponding surface on the receiver key to bias the electrical interface against the corresponding electrical interface on the receiver.

7. The ink cartridge of claim 6, wherein the further alignment feature comprises a T shaped slot for receiving a T shaped guide rail on the receiver.

8. A set of ink cartridges for an inkjet printer, each cartridge comprising a fluid cartridge of claim 1 and each cartridge independently insertable into and removable from a corresponding bay in a single receiver, and each ink cartridge comprising:
   the reservoir for holding an ink;
   an ink port operatively connected to the reservoir;

wherein the keying feature comprises a keyway for receiving a key on the receiver bay, the keyway configured to, as the cartridge is inserted into the receiver bay, discriminate the cartridge from the other cartridges in the set to prevent the cartridge from being inserted into the wrong bay; and wherein the alignment feature comprises the datum surface in the keyway for engaging a corresponding surface on the receiver bay to bias the electrical interface against a corresponding electrical interface on in the receiver bay.

9. The cartridge set of claim 8, wherein:

the keyway for each cartridge comprises a first keyway for receiving a first key on the receiver bay and a second keyway extending parallel to the first keyway for receiving a second key on the receiver bay, the first keyway defined in part by a partition; and the datum surface is positioned on a first side of the partition interior to the first keyway.

10. The cartridge set of claim 9, wherein each cartridge further comprises a T shaped slot for receiving a T shaped guide rail on the receiver bay.

11. A fluid cartridge that is independently insertable into and removable from a corresponding bay in a carriage comprising a plurality of bays for receiving a corresponding plurality of fluid cartridges, the fluid cartridge comprising:

the reservoir for holding a fluid;

fluid port operatively connected to the reservoir; and a keying feature comprising a keyway for receiving a key located at the bay, the keyway to, as the cartridge is inserted into the bay, discriminate the cartridge from other cartridges carrying a different fluid to prevent the cartridge from being inserted into the wrong bay of the carriage;

wherein the keyway comprises a pattern of projections, or corresponding receiving openings for receiving projections, that corresponds to a key located at a bay of said carriage that is designated for receiving a cartridge carrying said fluid; and wherein the keyway comprises a datum surface for engaging a corresponding datum defined on the key located at the bay to bias an electrical interface of the fluid cartridge against a corresponding electrical interface on the bay; the datum surface being positioned on a first side of a partition and the electrical interface being positioned on a second side of the partition opposite the first side.

12. The cartridge of claim 11, further comprising:

an electrical interface;

an alignment feature configured to, as the cartridge is inserted into the bay, bias the electrical interface against a corresponding electrical interface in the bay.

13. The cartridge of claim 11, wherein said projections or corresponding receiving openings are tapered along an axis corresponding to an insertion direction of the cartridge into the corresponding bay.

14. The cartridge of claim 13, wherein at least one said receiving opening comprises a recess on a side of said opening for receiving an additional minor projection on a side of a corresponding projection.

15. The cartridge of claim 11, wherein said keyway comprises a rectangular array of elements.

16. The cartridge of claim 15, wherein said elements are tapered in a direction moving outward from said fluid cartridge.

17. The cartridge of claim 15, wherein said elements have a square cross-sectional shape along an axis corresponding to an insertion direction of the cartridge into said bay.

18. The cartridge of claim 15, wherein said elements have a circular cross-sectional shape along an axis corresponding to an insertion direction of the cartridge into said bay.

19. The cartridge of claim 15, wherein, within said array, some of said elements are joined with adjacent elements to form a unique keying pattern.

20. The cartridge of claim 19, wherein some of said joined elements form an L-shaped element.

* * * * *

UNITED STATES PATENT AND TRADEMARK OFFICE

CERTIFICATE OF CORRECTION

PATENT NO. : 8,727,516 B2
APPLICATION NO. : 13/880332
DATED : May 20, 2014
INVENTOR(S) : David C. Harvey et al.

It is certified that error appears in the above-identified patent and that said Letters Patent is hereby corrected as shown below:

In the Claims

In column 5, line 10, in Claim 8, delete "on in the" and insert -- on the --, therefor.

Signed and Sealed this
Second Day of September, 2014

Michelle K. Lee

Michelle K. Lee
*Deputy Director of the United States Patent and Trademark Office*